US007473131B2

(12) United States Patent
Dunwoody et al.

(10) Patent No.: US 7,473,131 B2
(45) Date of Patent: Jan. 6, 2009

(54) CONNECTOR WITH COMPLIANT EMI GASKET

(75) Inventors: Steven David Dunwoody, Middletown, PA (US); Robert Neil Whiteman, Middletown, PA (US); Neil Franklin Schroll, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/345,988

(22) Filed: Feb. 2, 2006

(65) Prior Publication Data

US 2007/0178762 A1 Aug. 2, 2007

(51) Int. Cl.
*H01R 13/648* (2006.01)

(52) U.S. Cl. ..... 439/607; 174/35 GC; 361/818

(58) Field of Classification Search ..... 439/607, 439/939; 174/35 GC; 361/753, 788, 799, 361/800, 816, 818
See application file for complete search history.

(56) References Cited

U.S. PATENT DOCUMENTS 3,366,918 A * 1/1968 Johnson et al. ..... 439/607
4,386,814 A * 6/1983 Asick ..... 439/607
5,755,595 A 5/1998 Davis et al.
5,838,550 A * 11/1998 Morris et al. ..... 361/818
5,959,244 A * 9/1999 Mayer ..... 174/369
5,975,953 A * 11/1999 Peterson ..... 439/607
6,005,186 A * 12/1999 Bachman ..... 174/377
6,033,263 A * 3/2000 Weidler et al. ..... 439/620.1
6,095,862 A 8/2000 Doye et al.
6,231,356 B1 * 5/2001 Stutts et al. ..... 439/92
6,280,257 B1 * 8/2001 North et al. ..... 439/680
6,444,900 B1 9/2002 Casey
6,607,308 B2 * 8/2003 Dair et al. ..... 385/92
6,874,953 B2 * 4/2005 Dair et al. ..... 385/92
7,077,696 B2 * 7/2006 Haga et al. ..... 439/553

* cited by examiner

*Primary Examiner*—Renee Luebke
*Assistant Examiner*—Larisa Tsukerman

(57) ABSTRACT

An EMI gasket for a panel mounted connector includes a backplate comprising a conductive strip having upper and lower edges. The conductive strip is configured to engage and be held between a panel interface of the panel mounted connector and a rearward side of a panel to provide an EMI connection between the panel mounted connector and the panel. A mating interface beam extends from the conductive strip. The mating interface beam is configured to project through an opening in the panel. The mating interface beam is configured to engage a mating connector on a forward side of the panel to provide an EMI connection between the EMI gasket and the mating connector.

18 Claims, 4 Drawing Sheets

CONNECTOR WITH COMPLIANT EMI GASKET

BACKGROUND OF THE INVENTION

The invention relates generally to the shielding of electromagnetic interference and, more particularly to a compliant gasket for shielding electromagnetic interference in a panel mounted connector.

Electromagnetic interference (EMI) is commonly encountered in the operation of electronic systems. EMI can cause electronic equipment to malfunction when the equipment is not sufficiently shielded. EMI becomes more problematic as processing speeds increase. Compressive gaskets are commonly applied around connections between electrical components to suppress EMI.

Some known gaskets are made from a conductive rubber, which is inserted into a channel between two mating surfaces. Alternatively, the gasket may be glued to the inside of the channel. In such arrangements, the channel is used to provide lateral stability for the gasket and to prevent misalignment that could result over time from the repeated separation of the components. In another known shielding method, a compressible gasket is formed from a conductive metal and attached to a metal band along its length. The metal band is sandwiched between the mating surfaces of the components when the components are mated. In both cases, the gasket is intended to provide conductivity to ensure DC continuity between mating surfaces in addition to being compressible.

Standards have been developed for some applications, including panel mount connector applications. The standards define such things as the connector footprint, the connector mating face, and EMI. At least some users, however, have found the standards for EMI insufficient for particular applications. Tolerances associated with the positioning of connectors within the panel require that the gasket have a deflection range sufficient to effectively seal the connector against EMI around the perimeter of the connector. Thus, there remains a need for an EMI shield suitable for use in a high speed environment and that allows for higher densities of connections at the panel.

BRIEF DESCRIPTION OF THE INVENTION

In one aspect, an EMI gasket for a panel mounted connector is provided. The EMI gasket includes a backplate comprising a conductive strip having upper and lower edges. The conductive strip is configured to engage and be held between a panel interface of the panel mounted connector and a rearward side of a panel to provide an EMI connection between the panel mounted connector and the panel. A mating interface beam extends from the conductive strip. The mating interface beam is configured to project through an opening in the panel. The mating interface beam is configured to engage a mating connector on a forward side of the panel to provide an EMI connection between the EMI gasket and the mating connector.

Optionally, the backplate further includes a plurality of interconnected tabs and panel beams extending from the upper edge of the conductive strip. The panel beams are configured to engage the rearward side of the panel. The panel beams extend from the upper edge of the conductive strip. Each panel beam includes a base portion, a contact tip, and a bend between the base portion and the contact tip. The contact tip projects forwardly from the base portion. The mating interface beam is configured to be received in channels formed on an outer surface the panel mounted connector. The mating interface beam is configured to engage an inner surface of the mating connector.

In another aspect, an electrical connector assembly is provided that includes a connector configured to be mounted to a panel. The connector has a housing including a panel interface and a shroud defining a connector mating end. The housing is configured to be mounted to a rearward side of the panel. An EMI gasket is attached to the housing at the panel interface. The EMI gasket includes a backplate located between the housing and the panel. The backplate includes a conductive strip having upper and lower edges. The conductive strip is configured to engage a rearward side of the panel to provide an EMI connection between the connector and the panel. A mating interface beam extends from the conductive strip. The mating interface beam is configured to project through an opening in the panel. The mating interface beam is configured to engage a mating connector on a forward side of the panel to provide an EMI connection between the EMI gasket and the mating connector.

DETAILED DESCRIPTION OF THE INVENTION

Figure 1:
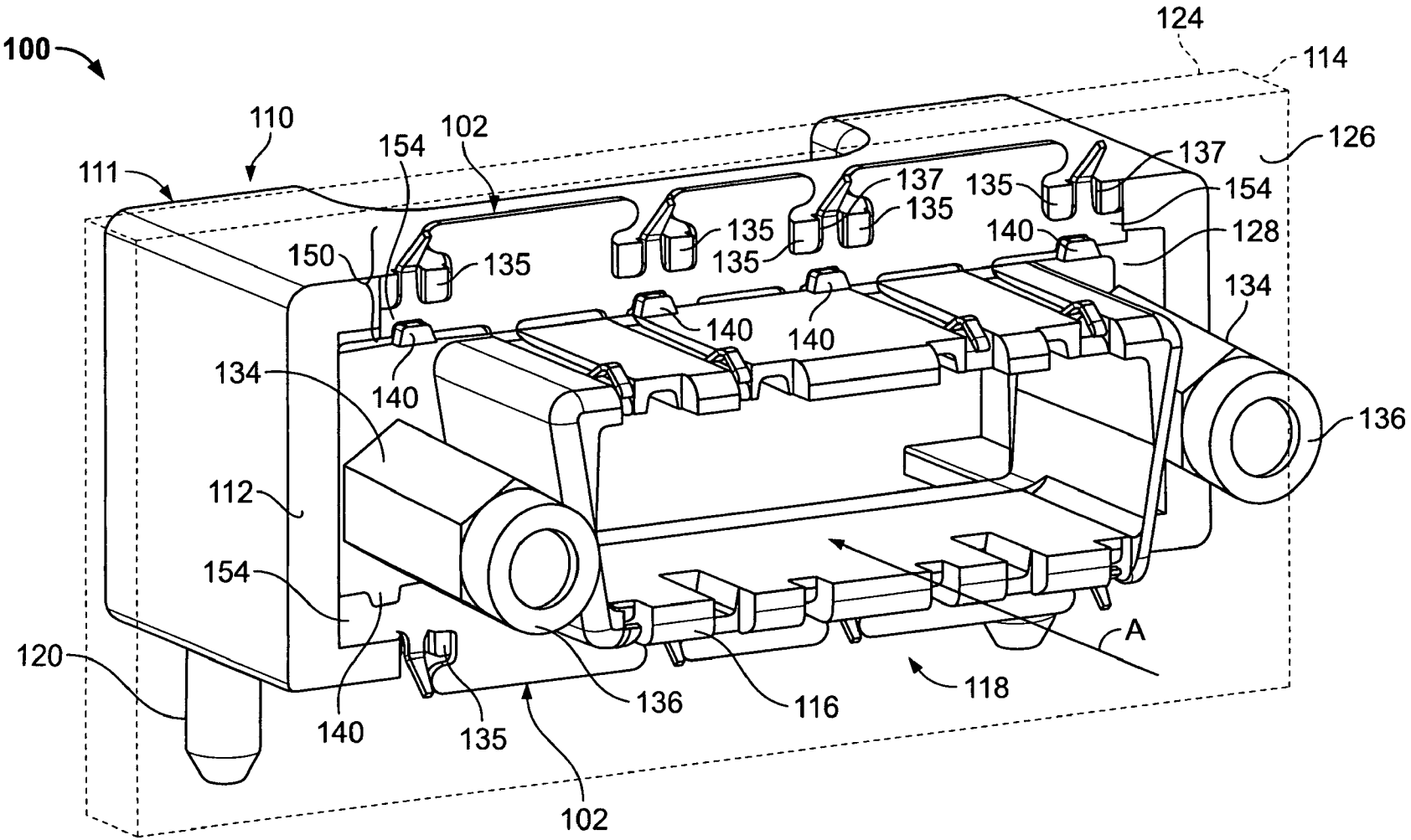
FIG. 1 is a perspective view of a panel mounted connector assembly including an EMI gasket formed in accordance with an exemplary embodiment of the present invention.
Figure 4:
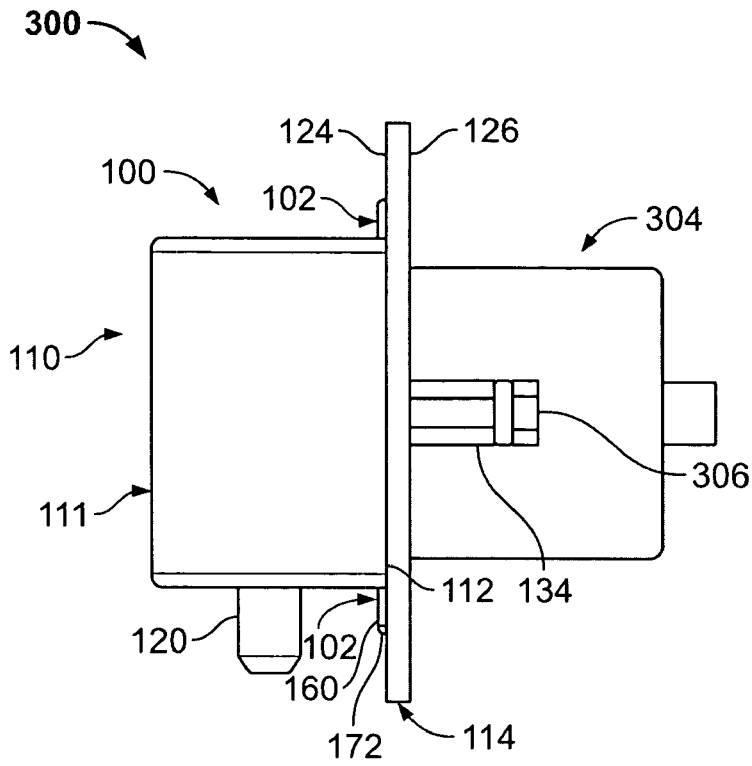
FIG. 4 is a side elevational view of a connector assembly including the panel mounted connector assembly shown in FIG. 1.

FIG. 1 illustrates a perspective view of a panel mounted connector assembly 100 including an EMI gasket 102 formed in accordance with an exemplary embodiment of the present invention. The assembly further includes a connector 110 that is mounted to a panel 114, which is shown in phantom. The EMI gasket 102 is provided in identical pairs that are positioned between the connector 110 and the panel 114. The connector 110 includes a housing 111 having a panel interface 112 configured to abut against the panel 114. The connector 110 includes a shroud 116 extending forward from the panel interface 112 that defines a mating end 118 of the connector 110. Alignment posts 120 are provided for mounting the connector 110 on a circuit board. The panel interface 112 includes upper alignment posts 135 with notches 137 therebetween. Lower alignment posts 140 are located proximate the shroud 116 at the panel interface 112. The upper and lower alignment posts 135 and 140, respectively, receive the EMI gasket 102. Ordinarily, the connector 110 includes a plurality of electrical contacts (not shown) held therein such that the contact mating ends are positioned within the shroud 116 and are configured to mate with contacts in a mating connector 304 (FIG. 4). When contacts are present, the contacts are connected to conductors that are mounted to a circuit board (not shown). The connector 110 is mounted to a rearward side 124 of the panel 114 which is provided with an opening 128 sized to receive the shroud 116. The shroud 116 extends through the panel 114 so the mating end 118 of the connector 110 is located on a forward side 126 of the panel 114. The mating connector 304 is mated to the connector 110 from a mating direction indicated by the arrow A.

As illustrated in FIG. 1, the assembly 100 also includes screw locks 134 that are provided to hold the connector 110 on the panel 114. The panel 114 is also a conductive member. The screw locks 134 also include receptacle ends 136 for mounting a mating connector 304 (FIG. 4) to the connector 110. As illustrated in FIG. 1, the connector 110 is shown as a receptacle connector and will be described in terms of the same. It is to be understood however, that the following description is for illustration purposes and no limitation is intended thereby.

Figure 2:
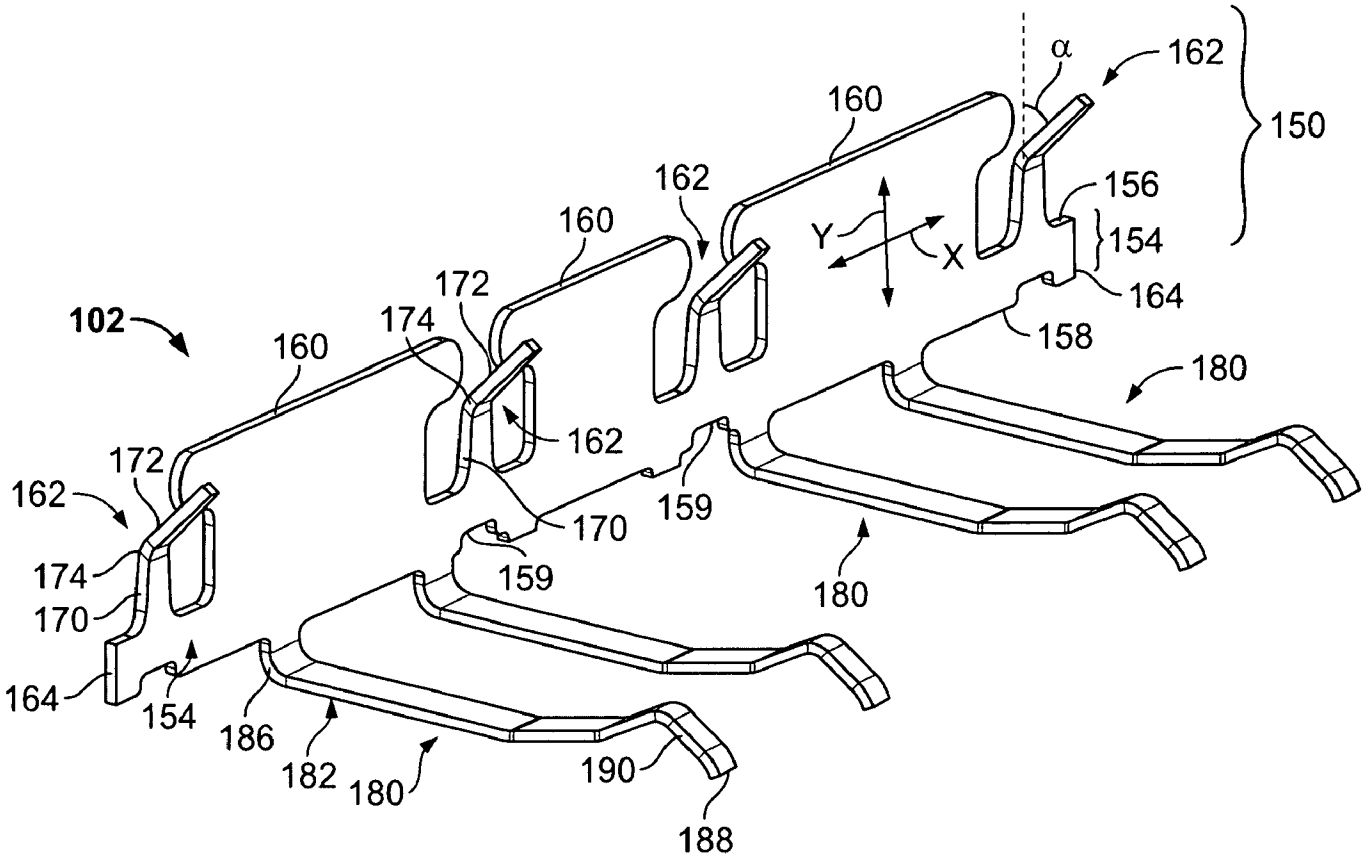
FIG. 2 is a perspective view of the EMI gasket shown in FIG. 1.

FIG. 2 illustrates a perspective view of the EMI gasket 102. The EMI gasket 102 is formed from a conductive material and includes a backplate 150 that is positioned between the connector 110 and the panel 114 as illustrated in FIG. 1. The backplate 150 includes a conductive strip 154 that is configured to engage a rearward side 124 of the panel 114 to provide a conductive connection between the EMI gasket 102 and the panel 114. More specifically, the conductive strip 154 includes an upper edge 156 and a lower edge 158. A plurality of interconnected tabs 160 are aligned substantially coplanar, denoted by X-Y axes, are spaced apart from one another and extend upwardly from the upper edge 156. The lower edge 158 includes a series of alignment notches 159 cut therein that receive the lower alignment posts 140 (FIG. 1) at the panel interface 112 (FIG. 1). A plurality of panel beams 162 are also formed and extend upwardly from the upper edge 156 of the conductive strip 154. In the illustrated embodiment, the tabs 160 and the panel beams 162 are formed in an alternating arrangement along the upper edge 156 of the strip 154 and a panel beam 162 is located proximate each end 164 of the conductive strip 154 and between adjacent tabs 160. Each panel beam 162 includes a base portion 170, a contact tip 172, and a bend 174 between the base portion 170 and the contact tip 172. The contact tip 172 projects forwardly from the base portion 170 at the bend 174 out of a tab plane (see X-Y axes) so that the contact tip of the panel beam 162 engages the rearward side 124 (FIG. 1) of the panel 114 when the EMI gasket 102 is in place on the connector 110 (FIG. 1). The base portions 170 are securely held in the notches 137 by posts 135 (FIG. 1).

The contact tips 172 of the panel beams 162 are bent forwardly at a bend angle $\alpha$ with respect to the base portions 170 of the panel beams. In an exemplary embodiment, the bend angle $\alpha$ is about forty five degrees. The tabs 160 are provided so that a technician may safely handle and install the EMI gaskets 102 on the connector 110 without altering the bend angle $\alpha$ of the panel beams 162.

The EMI gasket 102 further includes a plurality of mating interface beams 180 that extend from the lower edge 158 of the conductive strip 154. Each mating interface beam 180 projects forwardly from the conductive strip 154 and is configured to pass through an opening 128 in the panel 114 (see FIG. 1). The mating interface beam 180 is configured to engage a mating connector 304 (FIG. 4) on the forward side 126 of the panel (114) to provide an EMI connection between the EMI gasket 102 and the mating connector 304. The mating interface beam 180 includes a lever arm 182 having a first end 186 attached to the conductive strip 154 and a second end 188. A raised contact portion 190 is formed proximate the second end 188. The raised contact portion 190 is configured to engage the mating connector 304 as will be described.

Figure 3:
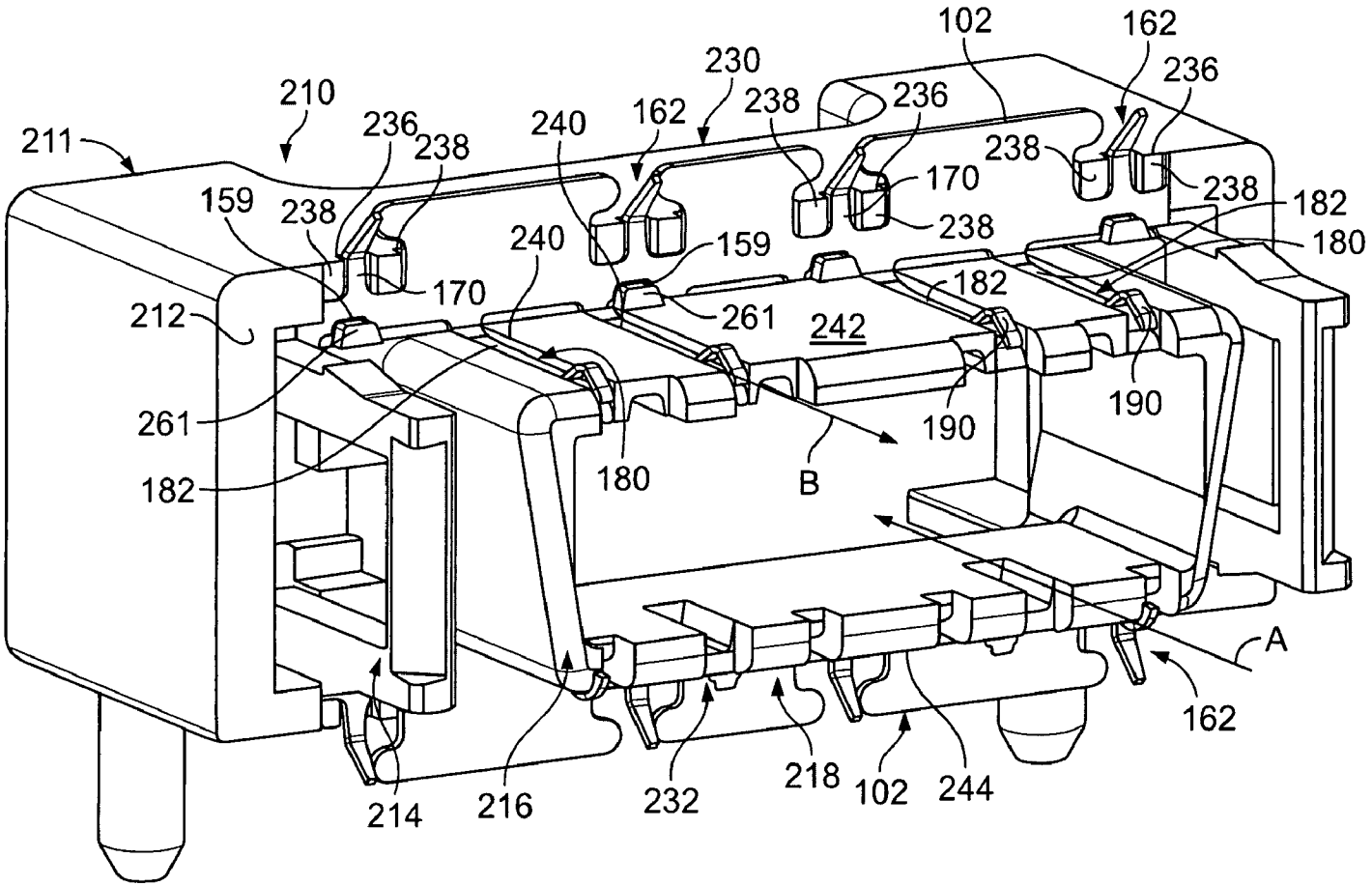
FIG. 3 is a perspective view of an alternative embodiment of a connector including the EMI gasket shown in FIG. 1.

FIG. 3 illustrates an alternative embodiment of a connector 210 that may receive the EMI gaskets 102. The connector 210 includes a housing 211 having a panel interface 212 that abuts against the panel 114. The connector 210 is provided with a latch mechanism 214 for holding the connector 210 on the panel 114 (FIG. 1) and for latching the connector 210 to a mating connector 304 (FIG. 4). In all other respects, the connector 210 is identical to the connector 110. The connector 210 includes a shroud 216 and a mating end 218. The connector 210 is provided with a pair of EMI gaskets 102, one on an upper side 230 of the connector 210 and one on a lower side 232 of the connector 210. The connector 210 includes notches 236 formed between upper alignment posts 238. The notches 236 receive the base portions 170 of the panel beams 162 to locate and retain the EMI gaskets 102 on the connector 210 so that the contact tips 172 of the panel beams 162 are pitched forward to engage the rearward side 124 of the panel 114 (FIG. 1). FIG. 3 also illustrates the alignment notches 159 to be fit over lower alignment posts 261 formed on the connector 210.

The mating interface beams 180 are received in channels 240 that are formed in upper and lower outer surfaces 242 and 244 respectively of the shroud 216. The mating interface beams 180 extend through the panel 114 (FIG. 1) in the direction of the arrow B, which is substantially opposite to the mating direction of a mating connector 304 (FIG. 4) as indicated by the arrow A. The raised contact portion 190 of the mating interface beams 180 are configured to engage an inner surface of the mating connector 304 to provide an EMI connection when the mating connector 304 is mated to the connector 210. The mating interface beams 180 engage the mating connector 304 proximate the forward side 126 of the panel 114. The mating interface beams 180, and particularly the lever arms 182, are flexible so that EMI contact between the raised contact portion 190 and the mating connector 304 is maintained with variations resulting from component tolerances or through relative movement between the connector 210 and the mating connector 304 that may result from cable loading, etc.

Figure 5:
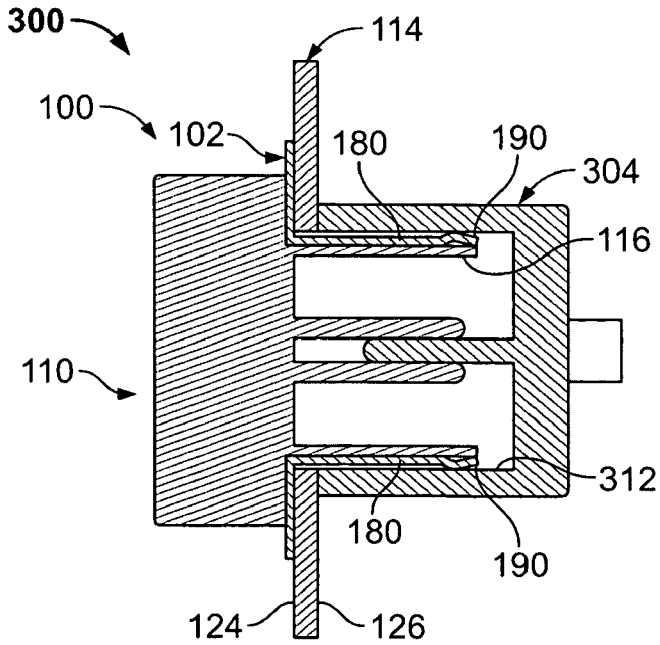
FIG. 5 is a cross sectional view of the connector assembly shown in FIG. 4 taken along one of the panel interface beams of the EMI gasket.

FIG. 4 illustrates a side elevational view of a connector assembly 300 including the panel mounted connector assembly 100 and a mating connector 304. FIG. 5 is a cross sectional view of the connector assembly shown in FIG. 4. The panel connector 110 is mounted on the rearward side 124 of the panel 114 with the panel interface 112 of the housing 111 in abutting engagement with the rearward side 124 of the panel 114. The connector 110 is held in place by the screw locks 134. The EMI gasket 102 is mounted on the connector 110 and, as illustrated in FIGS. 4 and 5, the contact tips 172 of the panel beams 162 are deflected so as to be substantially coplanar with the tabs 160 on the EMI gasket when the connector 110 is mounted to the panel 114. In the illustrated embodiment, the mating connector 304 is retained using a fastener 306 joined to the screw locks 134.

With reference to FIG. 5, the mating connector 304 includes a shell 308 that receives the shroud 116 of the connector 110. The mating interface beams 180 are also received in the shell 308 so that the raised contact portions 190 engage an inner surface 312 of the shell 308 to provide an EMI connection between the EMI gasket 102, the rearward side 124 of the panel 114, and the mating connector 304. The mating interface beams 180 and the contact portions 190 are flexible such that the EMI connection between the rearward side 124 of the panel 114, the EMI gasket 102, and the mating connector 304 is maintained even though there is relative movement between the connector 110 and the mating connector 304.

The embodiments thus described provide an EMI gasket 102 that provides more and reliable contact points in the mating interface beams 180 between the EMI gasket 102 and the mating connector 304. The EMI gasket 102 represents an improvement over the inflexible prior art bumps or dimples cast or formed into the connector shells which do not always make reliable contact. The EMI gasket 102 maintains EMI connections through component tolerances and other factors such as cable loading may interrupt contact between the connector shells. Compliance of the lever arms 182 can operate over several thousandths of an inch, to maintain contact and consistent EMI protection.

While the invention has been described in terms of various specific embodiments, those skilled in the art will recognize that the invention can be practiced with modification within the spirit and scope of the claims.

What is claimed is:

1. An EMI gasket for a panel mounted connector, said EMI gasket comprising:

a backplate comprising a conductive strip having upper and lower edges, said conductive strip configured to engage and be held between a panel interface of the panel mounted connector and a rearward side of a panel to provide an EMI connection between the panel mounted connector and the panel, the panel interface being substantially parallel to the rearward side of the panel; and a mating interface beam extending from said conductive strip, said mating interface beam configured to project through an opening in the panel and engage a mating connector on a forward side of the panel to provide an EMI connection between said EMI gasket and the mating connector, wherein said backplate further comprises a plurality of interconnected tabs and panel beams extending from said upper edge of said conductive strip, said panel beams being configured to engage the rearward side of the panel.

2. The EMI gasket of claim 1, wherein said backplate further comprises panel beams extending from said upper edge of said conductive strip, each said panel beam including a base portion, a contact tip, and a bend between said base portion and said contact tip, said contact tip projecting forwardly from said base portion.

3. The EMI gasket of claim 1, wherein said mating interface beam is configured to engage an outer surface of the panel mounted connector.

4. The EMI gasket of claim 1, wherein said mating interface beam is configured to engage an inner surface of the mating connector.

5. The EMI gasket of claim 1, wherein said mating interface beam is configured to be received in channels formed on an outer surface of the panel mounted connector.

6. The EMI gasket of claim 1, wherein said mating interface beam includes a lever arm having a first end attached to said conductive strip and a second end, and a raised contact portion formed proximate said second end.

7. The EMI gasket of claim 1, wherein said backplate further comprises panel beams extending from said upper edge of said conductive strip, each said panel beam including a base portion, a contact tip, and a bend between said base portion and said contact tip, said base portion being configured to be received in notches in the panel mounted connector.

8. The EMI gasket of claim 1, wherein said mating interface beam is configured to engage an inner surface of the mating connector.

9. The EMI gasket of claim 1, wherein said mating interface beam is configured to be received in channels formed on an outer surface of the panel mounted connector.

10. An electrical connector assembly comprising:

a connector configured to be mounted to a panel, said connector having a housing including a panel interface that is substantially parallel to the panel and a shroud defining a connector mating end, said housing configured to be mounted to a rearward side of the panel; and an EMI gasket attached to said housing at said panel interface, said EMI gasket comprising:

a backplate located between said housing and the panel, said backplate comprising a conductive strip having upper and lower edges, said conductive strip configured to engage and be held between the panel interface of the connector a rearward side of the panel to provide an EMI connection between said connector and the panel, the panel interface being substantially parallel to the rearward side of the panel, said backplate further comprising a plurality of interconnected tabs and panel beams extending from said upper edge of said conductive strip, said panel beams being configured to engage the rearward side of the panel; and a mating interface beam extending from said conductive strip, said mating interface beam configured to project through an opening in the panel and engage a mating connector on a forward side of the panel to provide an EMI connection between said EMI gasket and the mating connector.

11. The connector assembly of claim 10, wherein said backplate further comprises panel beams extending from said upper edge of said conductive strip, each said panel beam including a base portion, a contact tip, and a bend between said base portion and said contact tip, said contact tip projecting forwardly from said base portion.

12. The connector assembly of claim 10, wherein said mating interface beam is located on an outer surface of said housing.

13. The connector assembly of claim 10, wherein said mating interface beam is configured to engage an inner surface of the mating connector.

14. The connector assembly of claim 10, wherein said mating interface beam includes a lever arm having a first end attached to said conductive strip and a second end, and a raised contact portion formed proximate said second end.

15. The connector assembly of claim 10, wherein said housing includes notches formed above said shroud and said backplate further comprises panel beams extending from said upper edge of said conductive strip, each said panel beam including a base portion, a contact tip, and a bend between said base portion and said contact tip, said base portion being received in said notches in said housing.

16. An electrical connector assembly comprising:

a connector configured to be mounted to a panel, said connector having a housing including a panel interface that is substantially parallel to the panel and a shroud defining a connector mating end, said housing configured to be mounted to a rearward side of the panel; and an EMI gasket attached to said housing at said panel interface, said EMI gasket comprising:

a backplate located between said housing and the panel, said backplate comprising a conductive strip having upper and lower edges, said conductive strip configured to engage a rearward side of the panel to provide an EMI connection between said connector and the panel; and a mating interface beam extending from said conductive strip, said mating interface beam configured to project through an opening in the panel and engage a mating connector on a forward side of the panel to provide an EMI connection between said EMI gasket and the mating connector, wherein said shroud includes an outer surface and said mating interface beam is received in channels formed on said outer surface of said shroud.

17. The connector assembly of claim 16, wherein said mating interface beam is configured to engage an inner surface of the mating connector.

18. The connector assembly of claim 16, wherein said mating interface beam is configured to be received in channels formed on an outer surface of the connector configured to be mounted to the panel.

* * * * *